US007580236B2

(12) United States Patent
Avian

(10) Patent No.: US 7,580,236 B2
(45) Date of Patent: Aug. 25, 2009

(54) ELECTRONIC DEVICE FOR CONTROLLING ACTUATORS

(75) Inventor: Philippe Avian, Goyrans (FR)

(73) Assignee: Continental Automotive France, Toulouse (FR)

( * ) Notice: Subject to any disclaimer, the term of this patent is extended or adjusted under 35 U.S.C. 154(b) by 446 days.

(21) Appl. No.: 10/588,305

(22) PCT Filed: Feb. 1, 2005

(86) PCT No.: PCT/EP2005/000966

§ 371 (c)(1),
(2), (4) Date: Aug. 3, 2006

(87) PCT Pub. No.: WO2005/086348

PCT Pub. Date: Sep. 15, 2005

(65) Prior Publication Data

US 2008/0272822 A1 Nov. 6, 2008

(30) Foreign Application Priority Data

Feb. 5, 2004 (FR) ..... 04 01101

(51) Int. Cl.
*H01H 47/00* (2006.01)
*H01H 47/14* (2006.01)

(52) U.S. Cl. ..... 361/166

(58) Field of Classification Search ..... 361/166
See application file for complete search history.

(56) References Cited

U.S. PATENT DOCUMENTS 5,936,827 A * 8/1999 Dressler et al. ..... 361/154
7,057,870 B2 * 6/2006 Meyer et al. ..... 361/139

FOREIGN PATENT DOCUMENTS

| | | |
|---|---|---|
| DE | 37 02 680 | 10/1987 |
| EP | 1 260 694 | 11/2002 |
| JP | 2004-011494 | 1/2004 |

* cited by examiner

*Primary Examiner*—Ronald W Leja
(74) *Attorney, Agent, or Firm*—Young & Thompson

(57) ABSTRACT

A device (1) for controlling inductive loads (111, 112), includes:

several control stages (321, 322) having a bonding pad (331, 332) for an inductive load (321, 322), a receive input (301, 302) for a conduction activate signal, a switch (121, 122) including control and output electrodes;

an enabling circuit (181, 182) measuring the voltage applied to the pad (331, 332) and generating an enabling signal;

a conduction re-activate circuit (2) common to the control stages, limiting the voltage on the pad of the various stages to a common level and applying a conduction activate signal to the control electrode of a switch when the enabling signal is generated. The device can be used in particular to ensure an identical duration of supply to loads connected to the bonding pad.

11 Claims, 2 Drawing Sheets

Fig.3
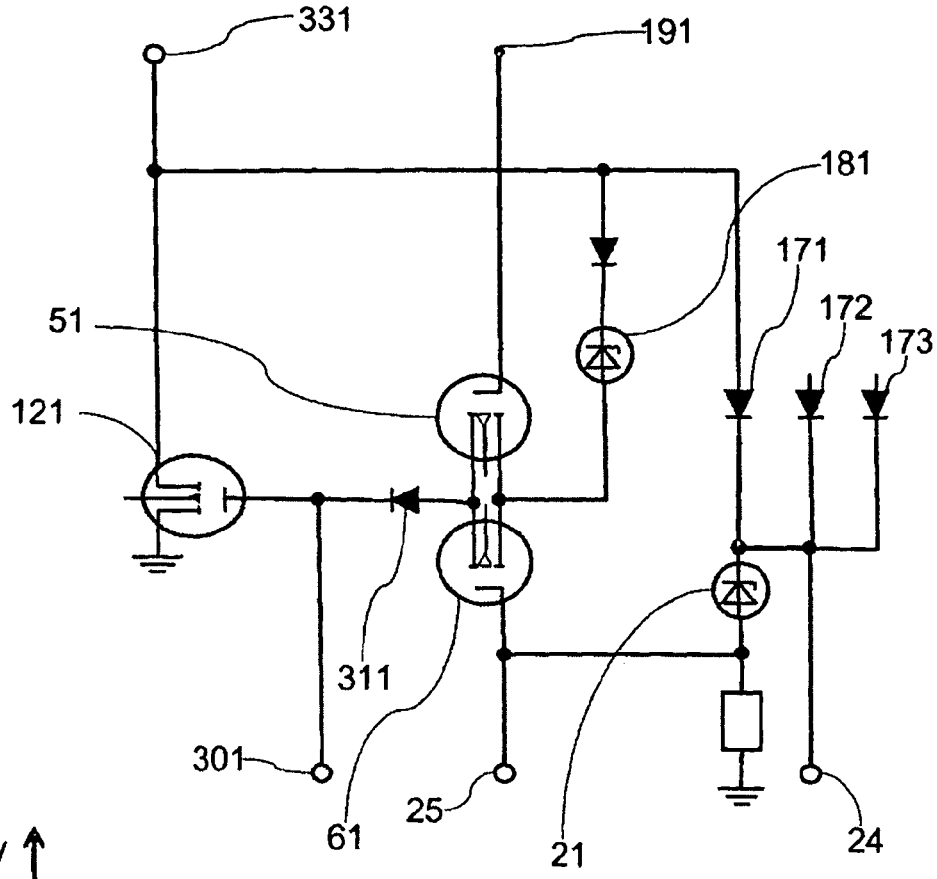
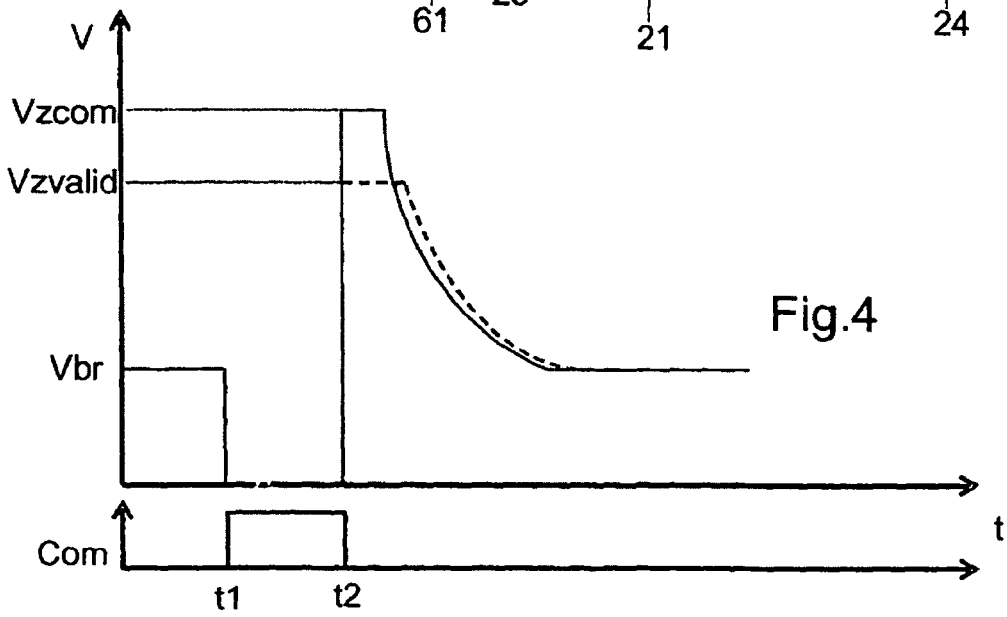
Fig.4

ELECTRONIC DEVICE FOR CONTROLLING ACTUATORS

BACKGROUND OF THE INVENTION

1. Field of the Invention

The invention concerns the control of several actuators, and more specifically the electronic devices for controlling several actuators.

2. Description of the Related Art

Such control devices are in particular used to control the sequential movement of needles of several injectors between an injection position and a closure position. The duration over which the needle is no longer in the closure position defines its duration of injection. To provide optimum operation of an internal combustion, it is desirable for the injection duration to be substantially identical in each cylinder of the engine.

An integrated circuit is presently marketed under the reference TLE 6244 by the company Infineon. This integrated circuit controls all the injectors of a combustion engine. This circuit has one control stage per injector. FIG. 1 schematically illustrates the control stage for an injector of this circuit. The load formed by an injector is illustrated by the inductance 11. The vehicle's battery voltage Vbr is applied to one of its terminals. Its other terminal is connected to the drain of a P-channel MOSFET transistor 12. The source of the MOSFET 12 is connected to ground. A Zener diode 13 and a diode 14 are connected between the drain and the gate of the transistor 12. The gate receives signals for controlling a controller which is not illustrated.

The control stage illustrated operates as follows:

The gate of the MOS is activated by the high state of the control signal. The MOS then becomes conducting and its drain voltage changes substantially from the voltage Vbr to zero voltage. When the control signal changes to the low state, the MOS then becomes blocked. Due to the rapid cutoff of the MOS, the inductance generates a rapid rise in the MOS drain voltage. When the drain voltage reaches the Zener voltage of the diode 13, the MOS is made conducting again and the drain voltage is held at the Zener voltage for a predetermined duration of discharge of the inductance. The amplitude of the Zener voltage defines the instant of closure of the needle associated with the inductance.

This control device exhibits drawbacks. Specifically, to obtain injection durations that are as similar as possible for the various cylinders, this control device imposes very tight tolerance limits on the electronic components. The cost of the electronic components used, and in particular the Zener diodes, is therefore high.

Furthermore, when several control stages are integrated in the same circuit, the tolerance obtained when the circuits are produced may remain acceptable. When at least two independent circuits are used to control the various injectors, the tolerance obtained by producing the circuits becomes inadequate.

Therefore a need exists which the invention aims to satisfy for a control device overcoming one or more of these drawbacks.

SUMMARY OF THE INVENTION

The invention thus relates to a device for controlling several inductive loads, which includes:

at least one first group of several control stages each having:

a bonding pad for an inductive load;

a receive input for a conduction activate signal;

a switch including a control electrode connected to the receive input, and an output electrode connected to the bonding pad;

an enabling circuit, measuring the voltage applied to the bonding pad and generating an enabling signal when this voltage reaches an enabling level;

a conduction re-activate circuit common to the control stages of the group, limiting the voltage on the bonding pad of the control stages of the group to a common level that is higher than the enabling level of each control stage of the group and applying a conduction activate signal to the control electrode for the switch of one of the control stages when the enabling circuit of this control stage generates an enabling signal.

According to a variant, the switch of each control stage of the group is a MOS transistor, the gate of which is the control electrode, the drain is the output electrode, and the source is connected to ground.

According to another variant, the conduction re-activate circuit includes a Zener diode connected in such a way as to substantially limit to its Zener voltage the voltage on the bonding pads of each of the control stages of the group.

According to another variant, the enabling circuit of each of the control stages includes a Zener diode connected between the output electrode and the control electrode and its Zener voltage defines the enabling threshold.

According to yet another variant, each control stage additionally includes a selection circuit having a selection input, disabling means disabling the application of the conduction re-activate signal from the common conduction re-activate circuit to the control electrode of the switch of this stage when a deselection signal is applied to its selection input, and means for applying a conduction re-activate signal to the control electrode of this switch when the voltage on the associated control pad reaches the enabling threshold of the associated enabling circuit.

Provision can also be made for the device to include at least one second group of control stages similar to the first group, the Zener diodes of their respective conduction re-activate circuit being connected together in parallel.

According to a variant, each group of control stages is produced on a separate board.

The invention also relates to a system including such a control device, a DC power supply, several loads each having a first terminal connected to the bonding pad of an associated control stage, and a second terminal connected to the DC power supply.

According to a variant, the level of the DC power supply is lower than the enabling threshold of each control stage.

According to another variant, several inductive loads are solenoids for actuating an injector needle.

BRIEF DESCRIPTION OF THE DRAWING FIGURES

The invention will be better understood from the appended figures, provided by way of example, and in which:

FIG. 1 represents a prior art injector control circuit;

FIG. 2 schematically represents a device for controlling several inductive loads according to one embodiment of the invention;

FIG. 3 shows details relating to one example implementation of the circuit of FIG. 2;

FIG. 4 shows a timing diagram illustrating an operating phase of the control device.

DETAILED DESCRIPTION OF THE INVENTION

The invention proposes a device for controlling several inductive loads having several control stages. Each stage has a bonding pad for an inductive load and a switch for the supply of power to the load. A signal for closing the switch is first applied for a certain length of time. The voltage on the bonding pad is measured, and an enabling signal is generated when this voltage reaches a predetermined threshold. The signal is representative of a voltage peak due to the opening of the switch. A stabilization circuit common to the control stages limits the voltage on the bonding pad to a common level that is higher than each enabling level. When the voltage on the bonding pad reaches the common level, the stabilization circuit closes the switch again and allows the evacuation of the energy still stored in the load.

Since the duration of this closure is defined by a voltage level that is common to the control stages, the associated loads can be controlled with an identical duration.

Figure 1:
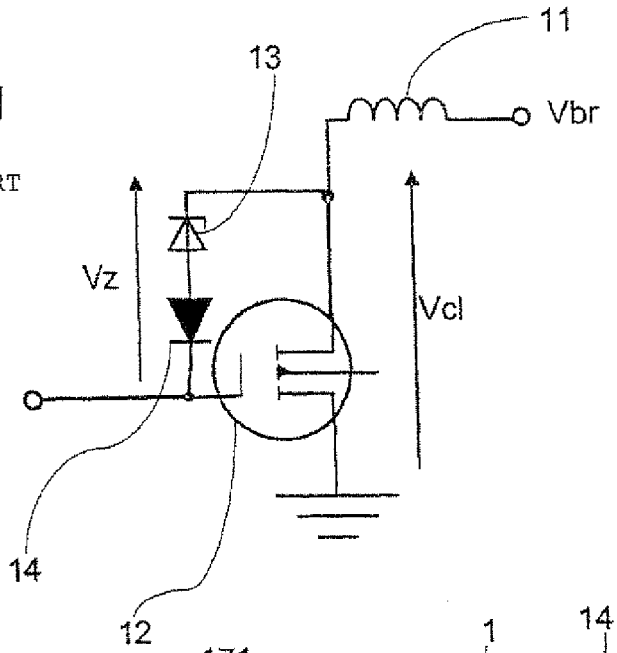
Fig. 1 PRIOR ART
Figure 2:
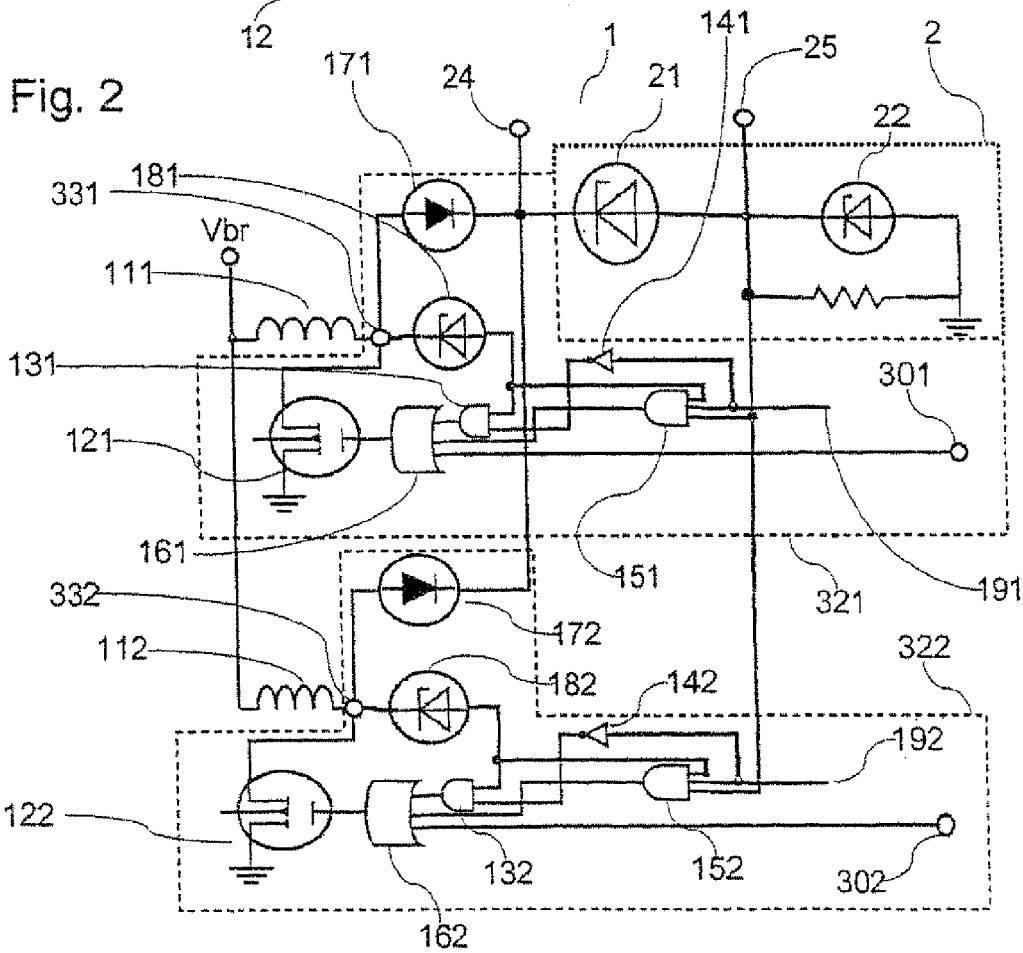

FIG. 2 schematically illustrates an embodiment of such a control device 1. The control device 1 includes two control stages 321 and 322, having pads 331 and 332, respectively, for the connection of a first terminal of loads 111 and 112 respectively. The second terminal of the loads 111 and 112 is supplied in this example by a voltage Vbr (for example a vehicle's battery voltage). The MOS transistors 121 and 122 are used as switches. Their drains are connected to the bonding pads 331 and 332 respectively, their sources are connected to ground and their gates receive a respective conduction activate signal via OR gates 161, 162. The OR gates 161, 162 have respective inputs 301, 302 intended to receive closure signals for the transistors 121, 122. These signals can be applied by an additional control unit for a predetermined duration in order to control the supply to the loads 111, 112. The supply to the various loads may in particular be carried out sequentially in some applications.

Each control stage has an enabling circuit which generates an enabling signal when the voltage applied to the associated bonding pad exceeds an enabling level. Each control stage has its own enabling circuit in order not to apply a conduction re-activate signal from the common circuit to the gate of the transistor of another control stage that must remain inactive.

In the example, the control stages 321 and 322 include Zener diodes 181 and 182 respectively, connected between the bonding pads 331, 332 and the inputs of AND gates 131, 132 and 151, 152. The Zener voltage of the diodes 181 and 182 is used to define the enabling threshold of the associated enabling circuit. The use of Zener diodes in the enabling circuit makes it possible to produce a control device according to the invention while introducing a minimum of structural modifications to a control device as described in the introduction. Preferably, provision will be made to satisfy the following rule for choosing the Zener voltages of the diodes:

$$1.05 < \frac{Vzcom}{Vzenable} < 1.2$$

where Vzcom is the Zener voltage of the Zener diode of the conduction re-activate circuit, and Vzenable is the Zener voltage of the Zener diode of an enabling circuit.

The conduction re-activate circuit 2 is common to the control stages 321 and 322. The circuit 2 is provided in order to limit the voltage on the bonding pads 331 and 332 to a common level that is higher than the enabling level of their enabling circuit. The circuit 2 is provided in order to apply a conduction activate signal to the control gate of the transistor 121 or 122, when an associated enabling signal has been generated. The MOS transistor concerned is then made conducting again and acts as a power Zener diode, evacuating the energy stored in the inductive load with a high discharge current.

Thus, the voltage on the bonding pad which will trigger a new closure of the transistor will be identical for the stages 321 and 322. The same closure duration can thus be defined for the transistors 121 and 122.

The circuit 2 illustrated in FIG. 2 includes a Zener diode 21 connected such that its Zener voltage defines the limit voltage on the bonding pads of the stages 321 and 322. The circuit 2 also has a Zener diode 22 intended to protect the control device. The control stages 321 and 322 have protection diodes 171 and 172, respectively, connected between the cathode of the diode 21 and, respectively, the bonding pads 331 and 332.

FIG. 2 schematically shows the logical link between the enabling circuits and the conduction re-activate circuit 2. In the control stage 321, the enabling circuit applies the enabling signal to an input of the AND gate 151. The anode of the Zener diode 21 is connected to another input of the gate 151. When the voltage applied to the bonding pad reaches approximately the Zener voltage of the diode 21, this diode 21 applies a conduction re-activate signal to the input of the gate 151. Since the two inputs of the gate 151 are enabled, the output of the gate 151 applies the conduction re-activate signal to an input of the OR gate 161. Since at least one input of the gate 161 is enabled, the conduction re-activate signal is applied to the gate of the transistor 121, which is then made conducting again.

The example of FIG. 2 illustrates a preferred variant associated with the enabling circuits equipped with a Zener diode. Each control stage has a selection circuit equipped with a selection input. The selection input is for switching a control stage between the common mode described previously and an independent mode. Whereas in the common mode, the common Zener diode 21 defines the voltage limit on the bonding pad and generates the conduction re-activate signal applied to the gate of the associated MOS transistor; these functions are provided by the Zener diode of the enabling circuit for this control stage in the independent mode. It is thus conceivable for different control stages having the same structure to be used for different uses. In particular provision can be made for using certain control stages to control injectors by placing them in common mode, and using another control stage in independent mode for a different application.

In the example, the control stages 321 and 322 have selection inputs 191 and 192 respectively. The inputs 191 and 192 are connected to another respective input of AND gates 151 and 152. The selection inputs 191, 192 are also connected via NOT gates 141, 142 to a respective input of AND gates 131, 132.

By applying a deselection signal, for example a logic low level to the input 191, the AND gate 151 is disabled and the AND gate 131 is enabled. Specifically, when the Zener voltage of the diode 181 is reached, the enabling signal applies a logic high level to the other input of the gate 131. The output of the gate 131 then enables the OR gate 161, this OR gate 161 then applying a conduction re-activate signal to the gate of the transistor 121.

FIG. 4 illustrates the respective voltages on the bonding pad 331 and on the input 301 in the two operating modes. In both modes, the bonding pad is initially at the level Vbr. Between the instant t1 and t2, a logic high level is applied to the input 301. The voltage on the input 301 then becomes substantially zero in both modes, since the transistor 121 is made conducting. At the instant t2, the signal on the input 301 changes back to the low state. The transistor 121 is blocked and the voltage on the pad 331 rises sharply. In the common mode, this voltage rises to the level Vzcom causing the generation of an enabling signal, and therefore the application of a conduction re-activate signal to the gate of the transistor 122. During the discharge, the voltage is first stabilized at the level Vzcom, then falls to the level Vbr. In the independent mode (discharge illustrated by the broken line), the voltage on the pad 331 rises to the level Vzenable; a conduction re-activate voltage is then applied to the gate of the transistor 122. During the discharge, the voltage is first stabilized at the level Vzenable, then falls to the level Vbr.

Although FIG. 2 represents a control device equipped with only two control stages, the control device can have a greater number of stages depending on the application desired.

It is conceivable for several groups of control stages to be made to operate in parallel, like those in FIG. 2. Each group and its conduction re-activate circuit can in particular be produced on a separate board, associated for example with the injectors of a bank of cylinders of an internal combustion. The next variant of the control device aims to define a common conduction re-activate voltage for several groups of control stages. To this end, the device 1 has terminals 24 and 25 for each group of control stages, intended to be connected together. The terminals 24 and 25 are connected respectively to the cathode and to the anode of the diode 21. Thus, these Zener diodes are connected in parallel. The lowest Zener voltage among these diodes defines the common limit voltage for the various groups connected.

FIG. 3 illustrates details of the circuit for implementing the logic functions described previously.

The input 301 is directly connected to the gate of the transistor 121. The selection input 191 is connected to the gate of the transistor 51. The source of the transistor 51 is connected to the anode of the diode 181 of the enabling circuit and its drain is connected to the gate of the transistor 121 via the diode 311. The gate of the transistor 61 is connected to the anode of the diode 21, its source is connected to the anode of the diode 181 and its drain is connected to the gate of the transistor 121 via the diode 311.

In independent mode, the transistor 51 is made conducting and the diode 181 applies a conduction re-activate signal to the gate of the transistor 121 when the bonding pad 331 reaches its Zener voltage. In common mode, the transistor 51 is blocked. When the bonding pad 331 reaches the Zener voltage of the diode 21, the transistor 61 is made conducting. The voltage on the bonding pad is then higher than the Zener voltage of the diode 181. A conduction re-activate signal is then applied to the gate of the transistor 121.

The protection diodes 172 and 173 belong to other control stages that are not detailed.

The diode 311 is for preventing other control stages placed in parallel from accidentally controlling the gate of the transistor 121.

This circuit can be simplified by eliminating the selection circuit. To this end, it is sufficient to eliminate the transistor 51 and the selection input 191.

I claim:

1. A device (1) for controlling several inductive loads (111, 112), characterized in that it includes:

at least one first group of several control stages (321, 322) each having:

a bonding pad (331, 332) for an inductive load (321, 322);

a receive input (301, 302) for a conduction activate signal;

a switch (121, 122) including a control electrode connected to the receive input, and an output electrode connected to the bonding pad;

an enabling circuit (181, 182), measuring the voltage applied to the bonding pad (331, 332) and generating an enabling signal when this voltage reaches an enabling level;

a conduction re-activate circuit (2) common to the control stages of the group, limiting the voltage on the bonding pad of the control stages of the group to a common level that is higher than the enabling level of each control stage of the group and applying a conduction activate signal to the control electrode for the switch of one of the control stages when the enabling circuit of this control stage generates an enabling signal.

2. The control device as claimed in claim 1, characterized in that the switch (121, 122) of each control stage of the group is a MOS transistor, the gate of which is the control electrode, the drain is the output electrode, and the source is connected to ground.

3. The control device as claimed in claim 1, characterized in that the conduction re-activate circuit includes a Zener diode (21) connected in such a way as to substantially limit to its Zener voltage the voltage on the bonding pads of each of the control stages of the group.

4. The control device as claimed in claim 1, characterized in that the enabling circuit of each of the control stages includes a Zener diode (181, 182) connected between the output electrode and the control electrode its Zener voltage defines the enabling threshold.

5. The device as claimed in claim 4, characterized in that each control stage additionally includes a selection circuit having a selection input (191, 192), disabling means (151, 152) disabling the application of the conduction re-activate signal from the common conduction re-activate circuit to the control electrode of the switch (121, 122) of this stage when a deselection signal is applied to its selection input, and means for applying a conduction re-activate signal to the control electrode of this switch when the voltage on the associated control pad reaches the enabling threshold of the associated enabling circuit.

6. The device as claimed in claim 3, characterized in that it includes at least one second group of control stages similar to the first group, the Zener diodes of their respective conduction re-activate circuit being connected together in parallel.

7. The device as claimed in claim 6, characterized in that each group of control stages is produced on a separate board.

8. A system including a control device as claimed in claim 1, characterized in that it includes a DC power supply (Vbr), several loads each having a first terminal connected to the bonding pad of an associated control stage, and a second terminal connected to the DC power supply.

9. The system as claimed in claim 8, characterized in that the level of the DC power supply (Vbr) is lower than the enabling threshold of each control stage.

10. The system as claimed in claim 8, characterized in that several inductive loads are solenoids for actuating an injector needle.

11. The control device as claimed in claim 2, characterized in that the conduction re-activate circuit includes a Zener diode (21) connected in such a way as to substantially limit to its Zener voltage the voltage on the bonding pads of each of the control stages of the group.

* * * * *

UNITED STATES PATENT AND TRADEMARK OFFICE

CERTIFICATE OF CORRECTION

PATENT NO. : 7,580,236 B2
APPLICATION NO. : 10/588305
DATED : August 25, 2009
INVENTOR(S) : Philippe Avian It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 468 days.

Signed and Sealed this

Fourteenth Day of September, 2010

David J. Kappos

David J. Kappos
*Director of the United States Patent and Trademark Office*